US006010105A

United States Patent [19]

Davis

[11] Patent Number: 6,010,105

[45] Date of Patent: Jan. 4, 2000

[54] HANGING DEVICE FOR SUSPENDING IMPLEMENTS

[76] Inventor: Richard A. Davis, 3208 36th Ave. West, Bradenton, Fla. 34205

[21] Appl. No.: 09/103,779

[22] Filed: Jun. 24, 1998

[51] Int. Cl.[7] ..... A47H 1/10

[52] U.S. Cl. ..... 248/317; 211/113; 211/118

[58] Field of Search ..... 248/317, 110, 248/690, 693, 309.1, 315, 318, 316.3; 211/113, 118, 60

[56] References Cited

U.S. PATENT DOCUMENTS

| | | | |
|---|---|---|---|
| 431,206 | 7/1890 | Gloy | 248/317 X |
| 1,447,579 | 3/1923 | Thomas . | |
| 1,598,403 | 8/1926 | Stockard . | |
| 1,803,569 | 5/1931 | Taylor . | |
| 2,131,956 | 10/1938 | Jones . | |
| 2,221,801 | 11/1940 | Keppinger . | |
| 2,480,327 | 8/1949 | Idelsohn | 211/113 |
| 2,618,419 | 11/1952 | Vanish . | |
| 3,556,454 | 1/1971 | Huver | 248/317 |
| 4,170,333 | 10/1979 | Angelastro | 248/110 |
| 5,323,996 | 6/1994 | Rendall | 248/315 |

*Primary Examiner*—Ramon O. Ramirez
*Attorney, Agent, or Firm*—Charles J. Prescott

[57] ABSTRACT

A hanging device for suspending one or more implements which have either elongated generally straight handles or body portions. The device includes one or a plurality of rings or annular members each having a central open area. Each ring is attached to one end of a length of flexible cord, string, cable and the like at a peripheral point of each ring. Each ring, when the other end of each cord is attached to an overhead support, will hang downwardly edgewise when not in use. An implement may be suspended for above ground or floor surface storage in a generally upright, freely swingable fashion by first passing the handle or body portion into the central open area of one ring, the central open area being somewhat larger than a diameter or thickness of the handle or body portion. By then allowing the handle or body portion to simply move by gravity into a generally upright orientation, the ring automatically moves into a canted position with respect to the handle or body portion and frictionally or penetratingly engages to hold and suspend the implement.

7 Claims, 5 Drawing Sheets

HANGING DEVICE FOR SUSPENDING IMPLEMENTS

BACKGROUND OF THE INVENTION

1. Scope of Invention

This invention relates generally to methods and devices for hanging and storing implements which include an elongated handle or body portion of a generally straight configuration, and more particularly to a hanging device which will suspend such implements by overhead attachment, the implements being suspended above ground or floor areas.

2. Prior Art

Storage of working and certain entertainment implements is highly desirable when they are not in use so as to minimize spacial storage requirements while maximizing easy access to these implements. One such device is disclosed by Angelastro in U.S. Pat. No. 4,170,333. This patent teaches a method and a device for suspending an implement having an elongated straight handle, the suspending device being attachable to an upright surface such as a wall.

Likewise, in U.S. Pat. No. 1,598,403 to Stockard, teaches a universal hanger which is pivotally connected to an eye screw in a wall surface. Keppinger, in U.S. Pat. No. 2,221,801 and Jones in U.S. Pat. No. 2,131,956 both teach devices for holding brooms, shovels and the like having elongated straight handles in a storage position adjacent to an upright wall surface. Each of these devices are also connected to and receive support from the wall surface to which they are attached.

Another such device is disclosed in U.S. Pat. No. 1,803,569 invented by Taylor for releasibly holding broom and mop handles to facilitate easy removal of these implements when needed. Two more devices of a similar nature except attached to a person or suspended in the ground are taught in U.S. Pat. Nos. 2,618,419 and 1,447,579, respectively, invented by Vanish and Thomas, respectively. The Vanish device teaches a holder for a hammer which is attachable to a user's belt. Thomas teaches the utilization of a self-supporting device when engaged into the ground for supporting the hose of a nozzle so as to facilitate watering a lawn or garden area.

The present invention teaches the hanging device which will suspendingly support implements having elongated handles or body portions above the ground. The upper end of the elongated cord members are attached at a lower end thereof to one ring or annular member per cord such that an implement may be held in a generally upright orientation above the ground or floor by each of the supported rings when the implement is not in use. The rings assume a canted orientation and wedge against opposite surfaces of the handle or body portion so as to wedgingly or frictionally engage thereagainst for providing support against gravity.

Of particular applicability, the device is sized by appropriate ring or annular member sized selection so as to engage around an elongated flexible Styrofoam float object which have become popularly known as "pool noodles". These elongated generally straight or slightly arcuate float members have become very popular around swimming pools, but are a nuisance to gather and store after being dried of pool water. The present invention facilitates the easy out-of-the-way storage of these elongated pool noodle type floats in upright hanging fashion above the floor or pool deck while also facilitating rapid drying thereof when stored.

Moreover, the device is so easily useable that even during short periods of non-use, it is not inconvenient to store the floats in the device to free the pool deck area of this clutter while making the floats readily available to resume their use. By providing an overhead support requirement for the device, more central location may also be chosen.

BRIEF SUMMARY OF THE INVENTION

This invention is directed to a hanging device for suspending one or more implements which have either elongated generally straight handles or body portions. The device includes one or a plurality of rings or annular members each having a central open area. Each ring is attached to one end of a length of flexible cord, string, cable and the like at a peripheral point of each ring. Each ring, when the other end of each cord is attached to an overhead support, will hang downwardly edgewise when not in use. An implement may be suspended for above ground or floor surface storage in a generally upright, freely swingable fashion by first passing the handle or body portion into the central open area of one ring, the central open area being somewhat larger than a diameter or thickness of the handle or body portion. By then allowing the handle or body portion to simply move by gravity into a generally upright orientation, the ring automatically moves into a canted position with respect to the handle or body portion and frictionally or penetratingly engages to hold and suspend the implement.

It is therefore an object of this invention to provide a hanging device for implements having elongated generally straight handles or main body portions, the hanging device itself being anchored or receiving support from any convenient overhead structure so that the implements are hung above the ground or floor area in otherwise freely swingable open area fashion.

It is another object of this invention to provide a hanging device specifically adapted for hanging pool noodles or swimming floats of a generally straight or broadly arcuate shape having a generally uniform Styrofoam cross sectional structure.

It is still another object of this invention to provide a hanging device suspended overhead which will operably engage with the handles or elongated generally straight body portions of a broad range of implements having various lengths and widths or thicknesses thereof.

In accordance with these and other objects which will become apparent hereinafter, the instant invention will now be described with reference to the accompanying drawings.

DETAILED DESCRIPTION OF THE INVENTION

Figure 1:
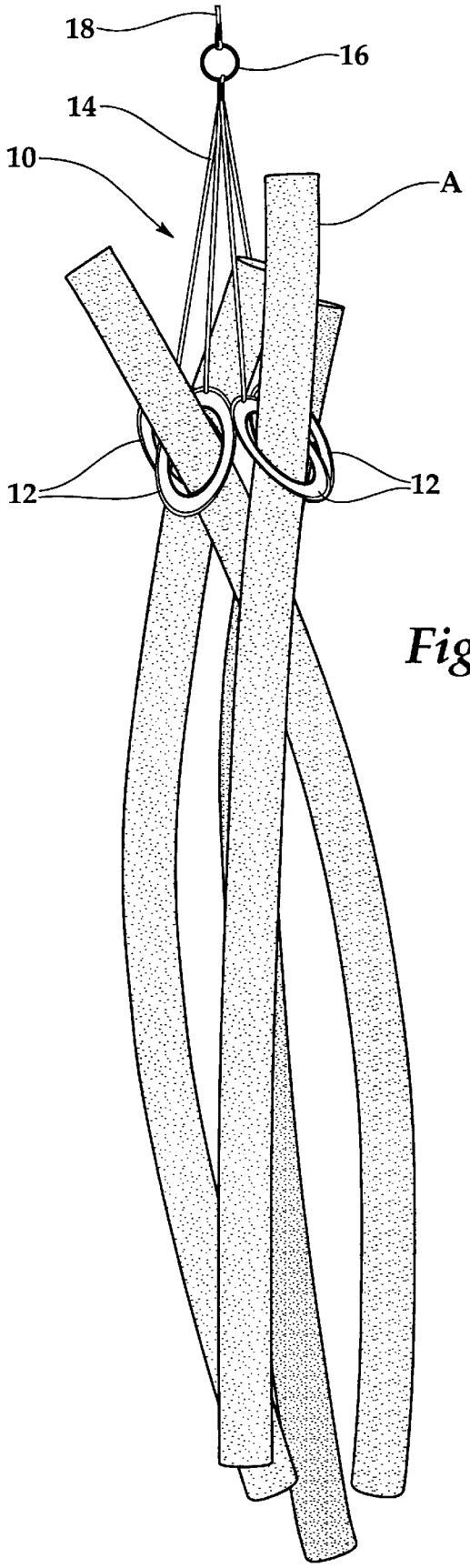
FIG. 1 is a pictorial view of the preferred embodiment of the invention in use.

Referring now to the drawings and particularly to FIGS. 1, 2A, 2B and 3, the preferred embodiment of the invention is shown generally at numeral 10 in use associated with a swimming pool cage surrounding a swimming pool in FIG. 1. The device 10 is shown supporting a plurality of elongated Styrofoam floats or pool noodles A.

Figure 2A:
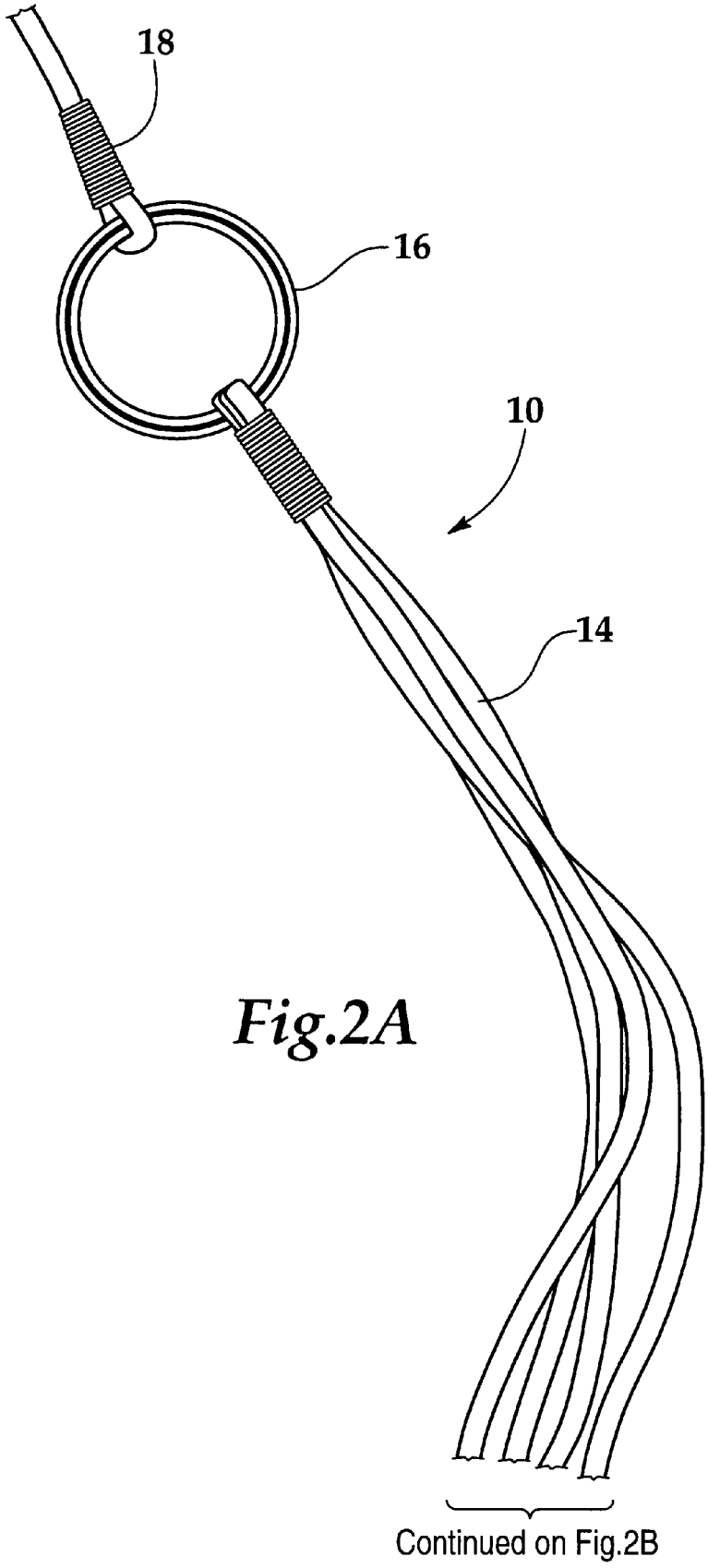
FIG. 2A is a plan view of the upper portion of the invention shown in FIG. 1

The upper portion of the device 10 as best seen in FIG. 2A, includes a plurality of flexible cords 14 which are knotted or otherwise bound together at a common point along a metal ring 16. be connected to an overhead structure such as a beam of the pool cage shown in FIG. 1. Metal ring 16 may also be decorative in nature.

Figure 2B:
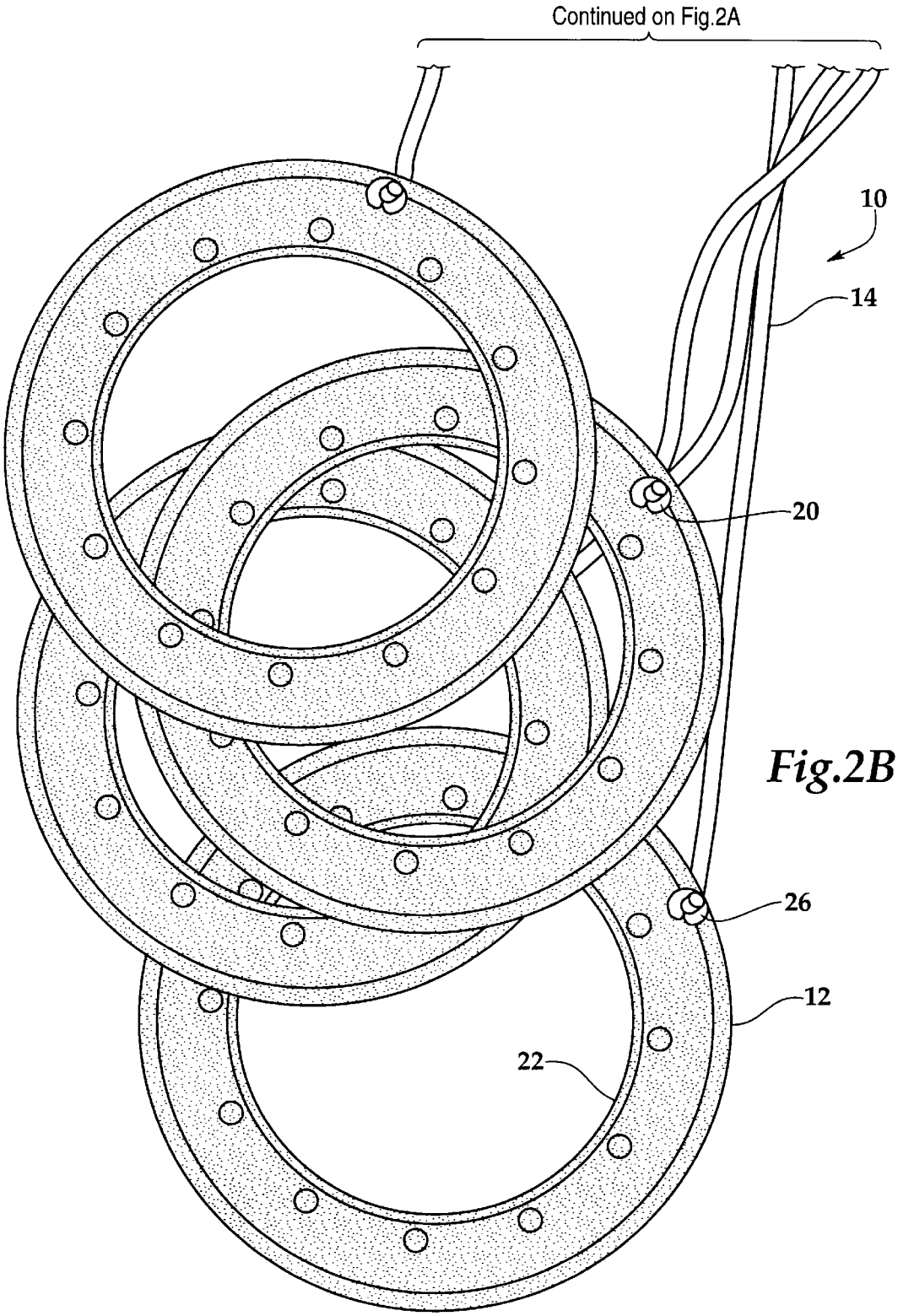
FIG. 2B which is a continuation of FIG. 2A shows the lower portion of the invention of FIG. 1.
Figure 3:
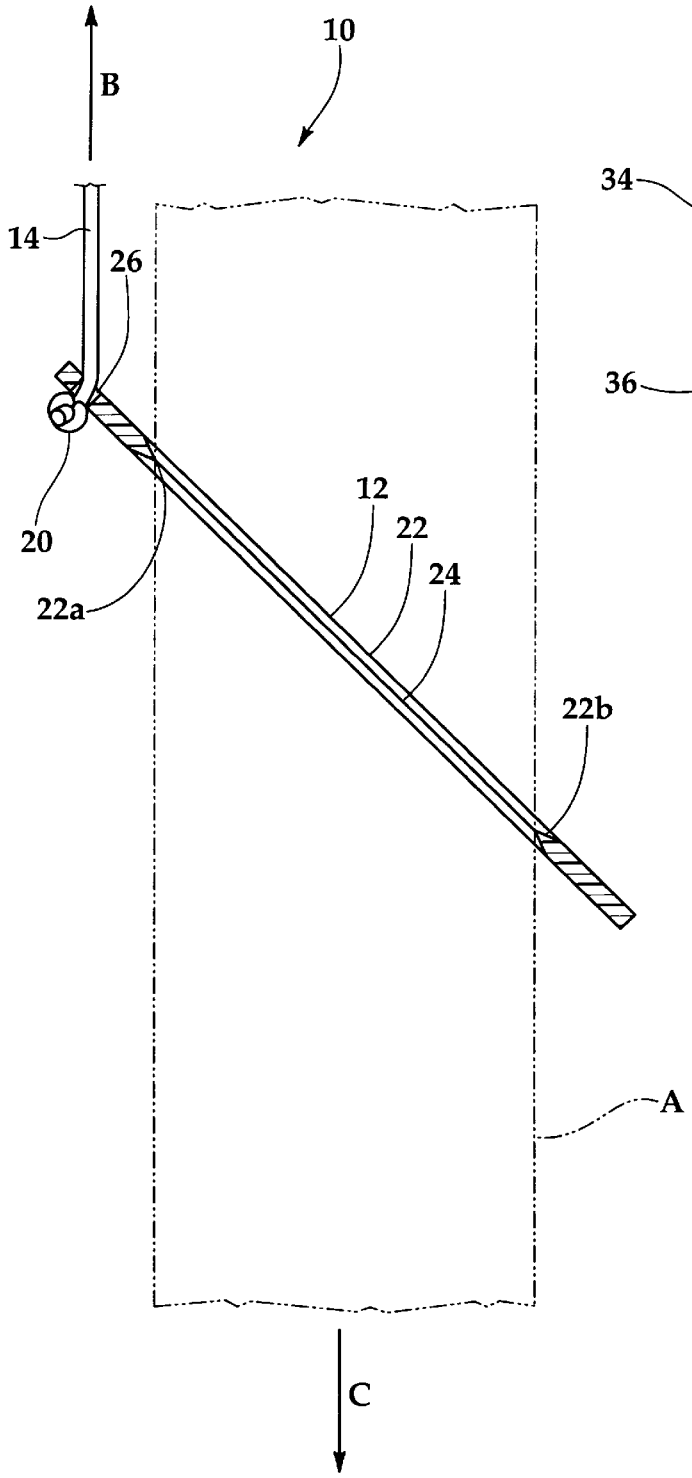
FIG. 3 is a simplified side elevation sectional view of the embodiment of the invention shown in FIG. 1 with the elongated handle or body portion of the supported implement in phantom.

As best seen in FIG. 2B, the lower end of each of the flexible cords 14 is connected to a ring or annular member 12 which defines a central round opening 22. These rings 12 are formed of plastic molded material, but may be manufactured in other convenient ways of both metallic and non-metallic materials. Each lower end of each cord 14 is connected by a knotted end 20 which is positioned against an aperture or hole 26 as also seen in FIG. 3. The hole 26 is positioned in close proximity to the outer peripheral margin or edge of each of the rings 12 so as to maximize the mechanical binding or self-locking effect of the device as described herebelow in supporting the handle or body portion A of an implement.

When in use as shown in FIGS. 1 and 3, the elongated pool floats A have been inserted through the central aperture 22 of one of the rings 12. The central open area 22 is sized in span between the edge of the opening immediately adjacent the cord connection aperture 26 and the opposite side of the opening 22 to be somewhat greater than the thickness or diameter of the object to be supported. The larger the ratio of central open area to the width or diameter of the handle or body portion being hung, the smaller the amount of cant or acute angle which each of the rings 12 assumes when in use supporting, in this case, a swimming pool float A.

By slidably inserting one end of the float A through the central open area of one ring 12, and then allowing the ring 12 to take the orientation shown in FIGS. 1 and 3 by lowering the pool float A, the opposite margins of the central open area 22 at 22A and 22B, assisted by their somewhat sharpened edge feature, dig into the Styrofoam material of the pool float A aided by the wedging effect of pulling on cord 14 in the direction of offset arrow B, while allowing gravity to exert a downward force in the direction of arrow C by the pool float A.

When not in use, the plurality of rings 12 simply hang downwardly in an upright orientation. For use, each of the pool floats A or implements of a similar elongated, somewhat straight configuration may be inserted through the central opening of one ring 12 and then allowed to simply hang by releasing the pool float A into the orientation shown in FIGS. 1 and 3.

Figure 4:
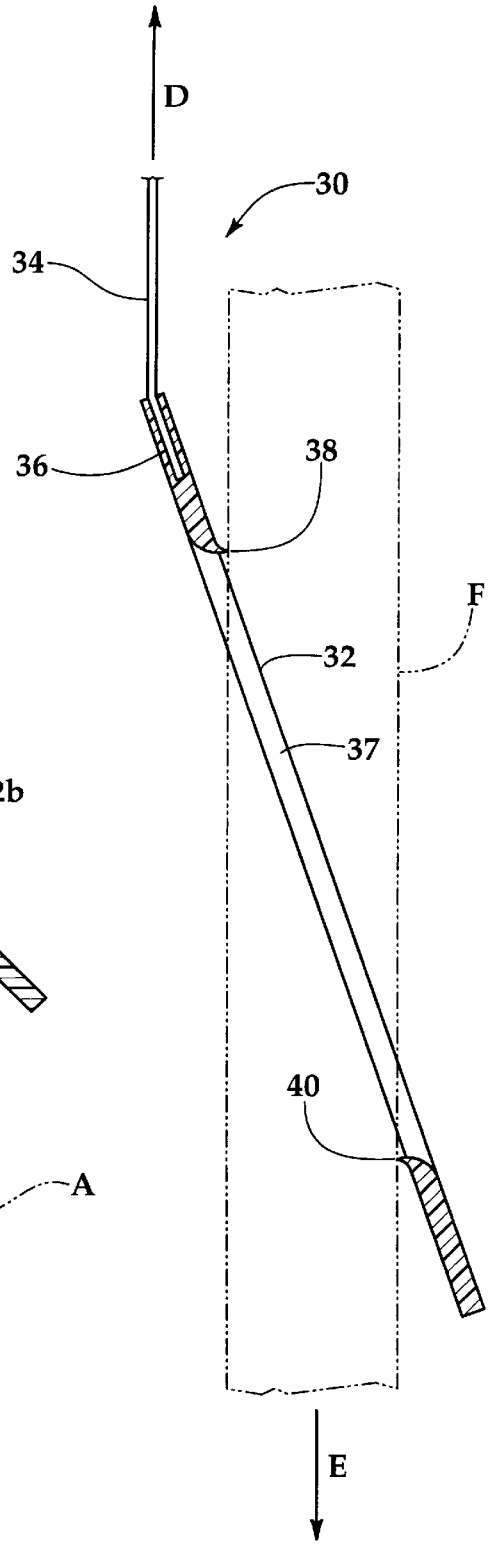
FIG. 4 is a side elevation section view of another embodiment of the invention showing the elongated handle or body portion of a supported implement in phantom.

Referring now to FIG. 4, another embodiment of the invention is there shown at numeral 30 and includes a ring or annular member 32 having a central open area 37. A handle F of an implement is shown proportioned closer to that of a conventional broom or shovel handle having somewhat heavier weight to support than as previously described in FIG. 1.

To accomplish supporting the higher weight which is reflected in a downward force of gravity in the direction of arrow E, the proportions of the central open area 37 to the diameter of the handle F are higher and in the range of about 4 to 1. By resisting the weight of the handle F and the associated implement in the direction of arrow E, the cords 34 must exert an equal higher force offset from E in the direction of arrow D. This heightens the frictional or caming engagement between the contacting edges of the open central area 37 against the side of the handle F.

To further heighten the releasable grip which the ring 32 is able to exert against the handle F when the implement is hung or suspended thereby, laterally extending prongs or barbs 38 and 40 are provided. Typically, working implements have handles F which are fabricated of wood and so that the barbs 38 and 40 will slightly penetrate thereinto to dramatically increase the ability of each of the rings 32 to support the heavier weight E of such implements. In this embodiment 30, the cord 34 is shown molded into and radially extends from a cavity 36 formed into the periphery of the ring 32.

Figure 5:
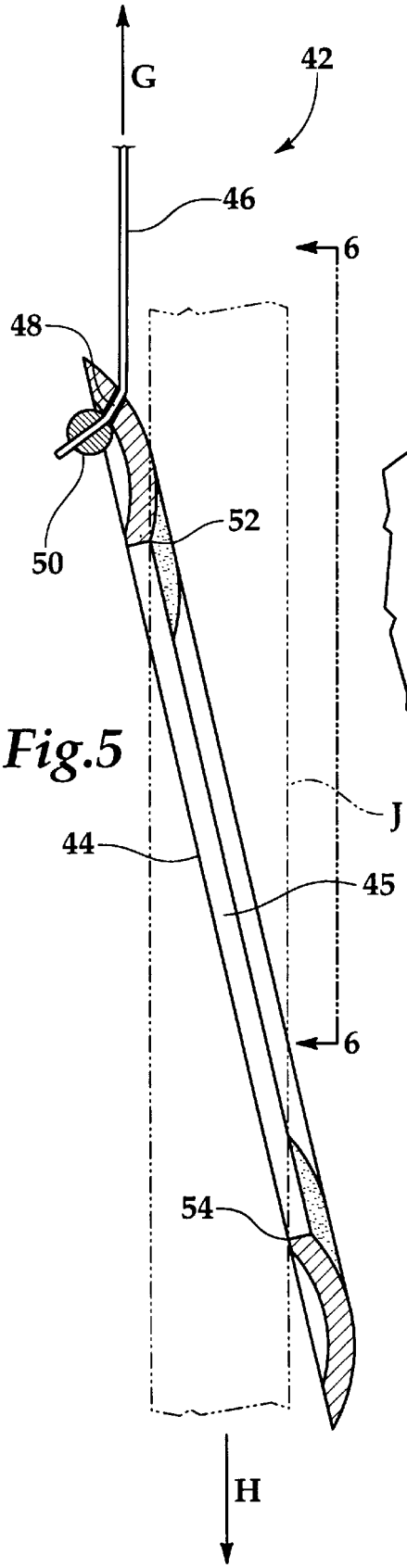
FIG. 5 is a side elevation section view of yet another embodiment of the invention showing the elongated handle or body portion of a supported implement in phantom.
Figure 6:
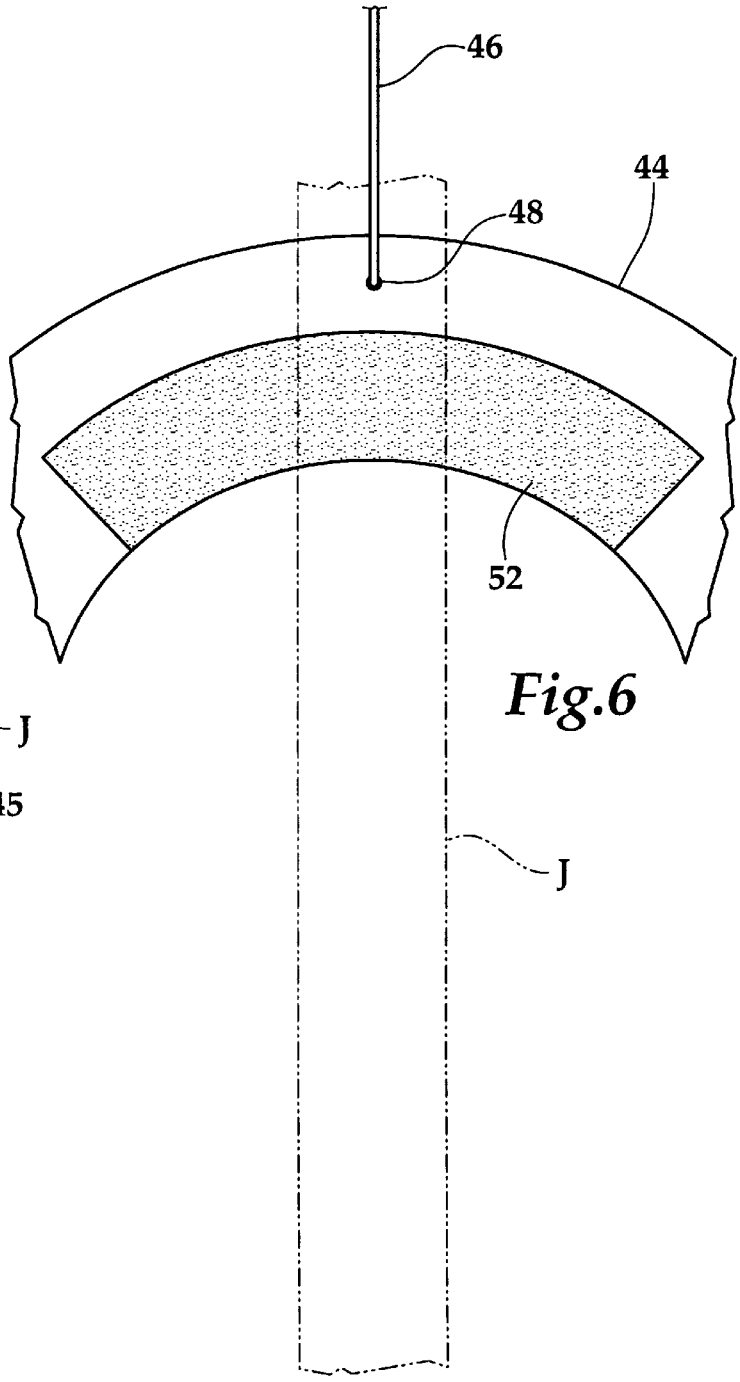
FIG. 6 is a view in the direction of arrows 6—6 in FIG. 5.

Referring lastly to FIGS. 5 and 6, another embodiment of the invention is shown generally at 42 and also includes a ring 44 having a central open area 45. This ring 44 is formed of stamped sheet metal for added strength.

This embodiment 42 is intended to suspendingly support the weights of even heavier implements by frictional engagement with their handles J. To accomplish this extra load bearing capacity, the diameter or span of the central open area has been increased to a ratio of about 6 to 1 with respect to the diameter or width of the handle J.

Additionally, abrasive material 52 has been added adjacent the interconnection of the lower end of cord 46 with an aperture 48 formed adjacent the outer peripheral margins of the ring 44. This abrasive surface 52 engages against the typically wooden handle J to heighten the frictional resistance to vertical movement therebetween when the handle J is suspended within ring 44 as shown. The inner margin 54, being somewhat sharpened, further increases the frictional releasably engageable grip against the opposite surface of handle J. In this embodiment 42, the lower end of cord 46 is retained within aperture 48 by a bead 50 which has been crimped onto the end of the cord 46 as shown.

Note that the rings in yet another embodiment may be made of rigid or semi-rigid elastomeric material or simply coated with same to further increase gripability of the device.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A hanging device for suspending implements having elongated somewhat straight rigid or semi-rigid handles or body portions, comprising:

at least one ring having a central open area;

a length of flexible cord connected at one end thereof to one point of said ring whereby said ring is held suspended by, and downwardly extending from, said cord when another end of said cord is attached to a support of sufficient height substantially longer than said cord to freely suspend said ring;

said open area sufficiently large in size for receiving the handle or body portion manually insertable therein and positioned in canted orientation at an acute angle to said ring whereby, when the handle or body portion is released in contact with opposing portions of said ring, said ring engagingly suspends the implement therefrom in a generally upright hanging orientation;

said ring includes a sharp prone positioned in close proximity to said one point and oriented for frictionally engage or releasibly penetrate the surface of the handle or body portion whereby holding force to suspend the implement is increased.

2. A hanging device for suspending a plurality of implements each having elongated somewhat straight rigid or semi-rigid handle or body portion, comprising:

a plurality of rings each having a central open area;

a plurality of flexible cords each connected at one end thereof to adjacent or at an outer edge margin of one of said rings whereby each said ring is held suspended by, and downwardly extends from one said cord when another end of each of said cords is attached to an upper support at a height substantially higher than a length of said cord to freely suspend said ring;

each said open area adapted to receive one handle or body portion manually insertable therein and positionable in canted orientation at an acute angle to said ring when the handle or body portion is released in contact with opposing portions of said ring, each said ring engagingly suspending the implement therefrom in a somewhat upright orientation.

3. A hanging device as set forth in claim 1, wherein:

each of said rings includes a sharp prong positioned in close proximity to said one point and oriented for frictionally engage or releasibly penetrate the surface of the handle or body portion whereby holding force to suspend the implement is increased.

4. A hanging device as set forth in claim 1, wherein:

each of said rings includes an abrasive area in close proximity to said one point and oriented for frictionally engage against the surface of the handle or body portion whereby holding force to suspend the implement is increased.

5. A hanging device as set forth in claim 1, wherein:

an inner edge of each of said rings is in close proximity to and opposite from said one point are sharpened whereby holding force to suspend the implement is increased.

6. A hanging device as set forth in claim 1, wherein:

a ratio of the size of an operative span of said central open area and a transverse thickness of the handle or body portion is up to about 6 to 1.

7. A hanging device for suspending implements having elongated somewhat straight rigid or semi-rigid handles or body portions, comprising:

at least one ring having a central open area;

a length of flexible cord connected at one end thereof to one point of said ring whereby said ring is held suspended by, and downwardly extending from, said cord when another end of said cord is attached to a support of sufficient height substantially longer than said cord to freely suspend said ring;

said open area sufficiently large in size for receiving the handle or body portion manually insertable therein and positioned in canted orientation at an acute angle to said ring whereby, when the handle or body portion is released in contact with opposing portions of said ring, said ring engagingly suspends the implement therefrom in a generally upright hanging orientation;

an inner edge of said ring is in close proximity to and opposite from said one point are sharpened whereby holding force to suspend the implement is increased.

* * * * *